United States Patent [19]

Mulcahy

[11] Patent Number: 4,777,999

[45] Date of Patent: Oct. 18, 1988

[54] USE OF MAGNETIC FIELD IN CONTINUOUS CASTING

[75] Inventor: Joseph A. Mulcahy, Brooklin, Canada

[73] Assignee: J. Mulcahy Enterprises, Whitby, Canada

[21] Appl. No.: 102,632

[22] Filed: Sep. 30, 1987

[51] Int. Cl.[4] ..... B22D 27/02

[52] U.S. Cl. ..... 164/467; 164/503

[58] Field of Search ..... 164/466, 467, 502, 503

[56] References Cited

U.S. PATENT DOCUMENTS 4,678,024 7/1987 Hull et al. ..... 164/503

FOREIGN PATENT DOCUMENTS 3127912 1/1983 Fed. Rep. of Germany ..... 164/503

*Primary Examiner*—Kuang Y. Lin

*Attorney, Agent, or Firm*—Sim & McBurney

[57] ABSTRACT

The continuous casting of heavy metals in a magnetic field is improved by using a magnetic field in the form of essentially uniform flux lines closely parallel to the casting surface. The instability experienced with the liquid meniscus is minimized and higher intensity fields, permitting casting of heavier metals, can be achieved.

5 Claims, 1 Drawing Sheet

USE OF MAGNETIC FIELD IN CONTINUOUS CASTING

FIELD OF THE INVENTION

The present invention relates to the continuous casting of heavy metals.

BACKGROUND TO THE INVENTION

The use of magnetic fields in the casting of heavy metals, such as aluminum is well known. In one known process, called "electromagnetic casting", an alternating magnetic field forces the aluminum away from the walls of the casting pit, so that no contact is provided between the metal and the mold during cooling, which produces aluminum ingots with smoother, cleaner surfaces.

This technique also has been applied to continuous casting wherein the conventional chill mold is replaced by a magnetic field which exerts a radial force on the molten metal. When the metal solidifies, it forms a column, which is lowered continuously at the same time as molten metal is supplied to the mold.

Problems arise, however, in the commercial application of such casting techniques. In particular, a rolling action often is experienced at the meniscus of the melt as a result of unbalanced magnetic forces acting on this area, which leads to surface imperfections in the cooled metal. In addition, metals heavier than aluminum, such as copper and iron, are difficult or impossible to process by such techniques, because of the much higher magnetic fields involved.

SUMMARY OF INVENTION

The present invention is directed to improvements in the continuous casting of heavy metals in the presence of a magnetic field which avoid the problems of the prior art discussed above and which enable a broader range of metals to be cast, including copper and iron.

In the present invention, a magnetic field in the form of essentially uniform flux lines closely parallel to the casting surface is employed. A magnetic field of this type minimizes the unbalanced forces which cause the meniscus to roll in the prior art. In addition, this type of magnetic field permits the higher magnetic intensities required by heavier metals to be achieved.

The essentially uniform flux lines of the magnetic field are achieved using a magnetic coil which has a reactance which is linear throughout its height. This result may be achieved by partially enclosing the magnetic coil within an inner core.

Another drawback of the prior art lies in the fact that, with the existing magnetic coil structure, the bottom of the liquid meniscus needs to be maintained at approximately the centre of the magnetic coil. The improved magnetic coil arrangement of the present invention enables a considerably-greater portion of the coil to be employed.

DESCRIPTION OF PREFERRED EMBODIMENT

Figure 1:
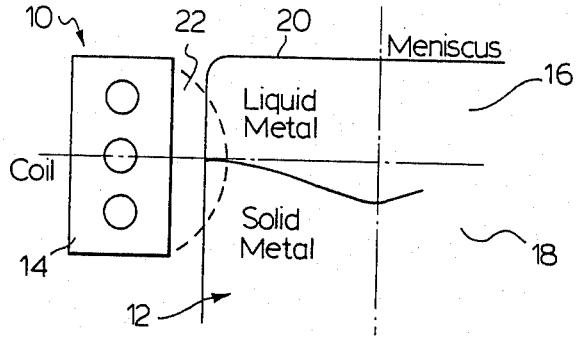
FIG. 1. PRIOR ART
FIG. 1 is a sectional view of part of an existing continuous casting mold.

Referring to FIG. 1, there is illustrated a continuous casting mold 10 wherein a strand of aluminum 12 is formed from a cast molten aluminum. A magnetic coil 14 surrounding the strand 12 exerts a magnetic field on the strand 12 and maintains the strand 12 away from the mold wall.

The liquid metals cools to form a solid metal which then is conveyed continuously downwardly and out of the mold. The liquid metal 16 initially cast is enclosed by the magnetic field and is on top of the solidified metal 18. The liquid metal 16 forms a meniscus 20. As can be seen, the magnetic field 22 to which the molten metal is subjected is uneven and this leads to instability in the meniscus 20.

Figure 2:
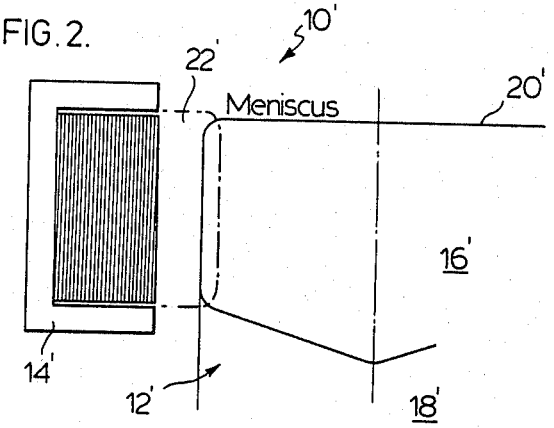
FIG. 2 is a sectional view of part of a continuous casting mold provided in accordance with one embodiment of the invention.

Referring now to FIG. 2, a continuous casting machine 10' is provided in accordance with one embodiment of the invention. In this instance, the liquid metal 16' is surrounded by an electromagnetic coil 14' of particular construction, more particularly seen in FIG. 3. The coil 14' produces a magnetic field 22' in the form of essentially uniform flux lines closely parallel to the casting surface 20'. The uniformity of the strength of the magnetic field through the height of the liquid metal 16' ensures stability of the meniscus 20'.

As may be seen by comparison between FIGS. 1 and 2, the usable height of the coil 14' extends for the height of the liquid metal 16' while in the case of coil 14, the centre line of the coil corresponds to the interface between the liquid metal 16 and the solid metal 18.

The ability to shape the magnetic lines in accordance with this invention enables differences in hydrostatic pressure in the liquid metal 16' to be accommodated and permitting the correct shape to be maintained during solidification and solidified metal skin formation. In addition, magnetic fields of higher intensity may be achieved, thereby permitting heavier metals to be processed.

Figure 3:
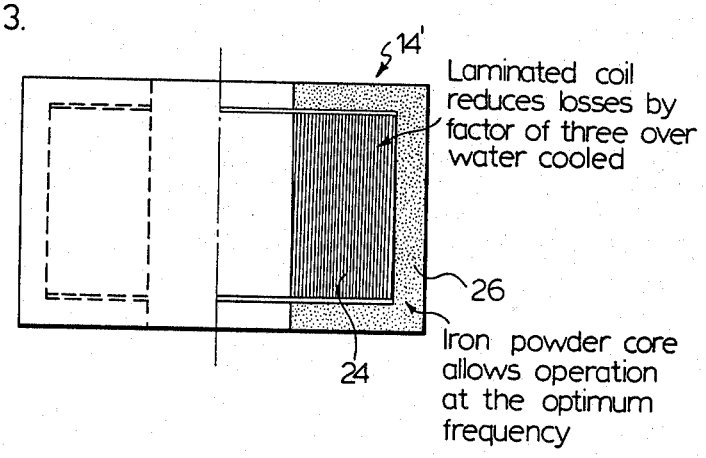
FIG. 3 is a partial sectional view of an electromagnetic coil useful in the continuous casting device of FIG. 2.

As seen in FIG. 3, the electromagnetic coil 14' is an annular structure of inside diameter sufficient to permit the coil to surround the metal strand 12'. A laminated coil 24 is accommodated within an iron powder core 26.

Although generally the procedure of the present invention is used to form metal strands of circular cross section, by appropriate alteration of the configuration of the coil, any other cross-sectional shape of metal strand, such as square or rectangular, may be produced.

SUMMARY OF DISCLOSURE

In summary of this disclosure, the present invention provides improvements in the casting of heavy metal in a magnetic field, which produce a more stable meniscus and hence improved product appearance and which enables heavier metals to be cast. Modifications are possible within the scope of this invention.

What I claim is:

1. In a method of continuous casting of a heavy metal in a vertical orientation wherein said heavy metal in the molten state is subjected to a magnetic field and is cooled from a liquid state to a solid state, the improvement which comprises providing said magnetic field in the form of essentially uniform flux lines closely parallel to an upper casting surface and having a physical height corresponding to the physical height of the metal in its molten state.

2. The method of claim 1 wherein said magnetic field is provided by magnetic coil which has a reactance which is linear throughout its height.

3. The method of claim 2 wherein said magnetic coil is partially enclosed within an iron core.

4. In a continuous casting mold having a vertical orientation and having an electromagnet for appyling a magnetic field to a molten heavy metal in a casting operation wherein said molten metal is cooled from a liquid state to a solid state, the improvement wherein said magnetic field is provided by a magnetic coil which has a reactance which is linear throughout its height and which has a physical height corresponding substantially to the intended physical height of molten metal in said mold and thereby produces a magnetic field in the form of essentially uniform flux lines closely parallel to an upper casting surface of molten metal cast in said mold.

5. The mold of claim 4 wherein said magnetic coil is enclosed within an iron core except in the portion intended to face the molten metal.

* * * * *